United States Patent [19]

Koval

[11] 4,051,683

[45] Oct. 4, 1977

[54] METHOD AND APPARATUS FOR SUPPORTING A MINE ROOF

[75] Inventor: Stephen F. Koval, Portage, Pa.

[73] Assignee: Jennmar Corporation, Cresson, Pa.

[21] Appl. No.: 700,600

[22] Filed: June 28, 1976

[51] Int. Cl.[2] ..... E21D 20/02

[52] U.S. Cl. ..... 61/45 B; 85/63

[58] Field of Search ..... 61/45 B, 63, 39, 35; 85/63, 61, 87, 72, 32 CS; 52/698, 704, 741

[56] References Cited

U.S. PATENT DOCUMENTS

| | | | |
|---|---|---|---|
| 2,952,129 | 9/1960 | Dempsey | 61/45 B |
| 3,188,815 | 6/1965 | Schuermann et al. | 61/45 B |
| 3,222,873 | 12/1965 | Williams | 61/45 B |
| 3,244,055 | 4/1966 | Schuermann et al. | 61/45 B X |
| 3,306,051 | 2/1967 | Howlett | 61/45 B |
| 3,336,758 | 8/1967 | Williams | 61/45 B X |
| 3,357,730 | 12/1967 | Siler | 85/61 UX |
| 3,877,235 | 4/1975 | Hill | 61/45 B |
| 3,896,627 | 7/1975 | Brown | 85/63 X |
| 3,940,941 | 3/1976 | Libert et al. | 85/63 |

FOREIGN PATENT DOCUMENTS

| | | | |
|---|---|---|---|
| 80,182 | 2/1963 | France | 61/45 B |

*Primary Examiner*—Dennis L. Taylor

*Attorney, Agent, or Firm*—Stanley J. Price, Jr.; John M. Adams

[57] ABSTRACT

A reinforcing rod having a threaded end portion with a coupling secured thereto is inserted in a drill hole of a rock formation, such as a mine roof, with the threaded end adjacent the emergent end of the drill hole and the opposite end in contact with cartridges containing a resinous composition positioned within the drill hole. A bolt having a threaded end portion is engaged to the coupling. A roof plate is retained on the opposite end of the bolt extending from the drill hole. A shear pin is positioned transversely in the coupling and maintains the adjacent end portions of the rod and the bolt in spaced relation to permit rotation of the connected rod and bolt in the drill hole to fracture the resin cartridges. Contact of the threaded end of the bolt with the shear pin maintains the roof plate spaced from the face of the rock formation as the resin is mixed and allowed to cure to adhesively bond the rod to the rock formation. With the rod anchored to the rock formation further rotation of the bolt advances the bolt through the coupling to shear the pin and urge the roof plate into abutting relation with the rock face. Continued rotation of the bolt tensions the bolt and compresses the rock strata to provide a reinforced rock formation.

19 Claims, 8 Drawing Figures

METHOD AND APPARATUS FOR SUPPORTING A MINE ROOF

BACKGROUND OF THE INVENTION

1. Field of the Invention

This invention relates to a method and apparatus for insertion in a drill hole of a rock formation to support the rock formation and more particularly to a roof support that includes a first section that is adhesively bonded to the rock formation and another section that is anchored to the adhesively bonded section and is tensioned to compress the rock strata.

2. Description of the Prior Art

In underground operations, such as mining or excavating, the unsupported rock formation is reinforced by bolt members that are inserted in a drill hole of the rock formation and are secured thereto by either engagement of an expansion shell on the end of the bolt with the rock formation or adhesively bonding the bolt by a thermosetting resin injected into the drill hole so that upon curing the bolt member is united with the rock formation. A roof plate is retained on the bolt and abuts the face of the rock formation. Rotating of the bolt having an expansion shell positioned on the opposite end thereof expands the shell to engage the rock formation with the bolt hole. The bolt is tensioned with the resultant affect of compressing the rock strata and thereby reinforcing the strata to resist shock waves that apply shear stresses to the rock formation.

Supporting a rock formation by a thermosetting resin system as illustrated and described in U.S. Pat. Nos. 3,324,662 and 3,394,527 disclose adhesively bonding a rod positioned in a drill hole to the rock by a thermosetting polyester resin composition having thixotropic properties. The resin composition includes principally two components, the polyester resin and a catalyst that are separately retained in a cartridge with a plurality of the cartridges positioned in the drill hole. Insertion of the rod in the hole compresses and fractures the cartridges and as the rod is rotated the components are intimately admixed to form an essentially homogeneous curable resin mixture. The resin mixture polymerizes at ambient temperature and penetrates into the rock to adhesively unite fissures in the rock and to firmly hold the rod in position in the drill hole. The resin fills the annulus between the drill hole and the rod substantially along the entire length of the rod.

A principal disadvantage with the mechanical roof bolt apparatus is the expense of the expansion shell. Furthermore, contact between the roof bolt and the rock formation is confined to engagement of the expansion shell with the rock formation. With this arrangement the bolt is anchored so that when the rod is rotated it is tensioned and the rock strata is compressed. It is not uncommon to require expansion bolts having a length in excess of eight feet in order to sufficiently support the rock strata to prevent failure of the mine roof. In mines of low seam height, i.e., less than four feet bolts of such a length are extremely difficult to insert in the bolt hole requiring that the bolt be bent as it is introduced into the drill hole. This disadvantage is also inherent with resin bolting. Furthermore, the resin bolting concept requires adhesion substantially the entire length of the rod member so that the rock strata may be sufficiently interlocked and the bolt bonded to the rock formation to resist the shear forces that tend to separate the strata. Further a sufficient quantity of resin composition must be inserted in the bolt hole to bond a bolt of substantial length to the rock formation. Again, limited overhead clearance in the mine presents substantial difficulty in inserting the proper quantity of resin and bolt of required length into the drill hole.

While it has been suggested by the prior art systems to support a rock formation, such as a roof of a mine, by mechanically securing the bolts within drill holes and adhesively bonding bolts to the rock formation, the prior art systems are not readily adaptable to insertion of roof bolts of a length that exceed the overhad clearance in a mine. There is need to provide a method and apparatus for supporting a rock formation such as a mine roof in which the elements for supporting the mine roof are easily inserted particularly for mines of a low seam height and are operable to support the mine roof to resist the forces that tend to generate failure of the rock formation in the roof.

SUMMARY OF THE INVENTION

In accordance with the present invention there is provided a method and apparatus for insertion in a drill hole of a rock formation to support the rock formation that includes an elongated reinforcing rod positioned in the drill hole. The reinforcing rod has one end portion positioned adjacent the end of the drill hole and an opposite threaded end portion. A resin system mixed and hardened in the drill hole fills the annulus between the rock formation and the reinforcing rod to anchor the reinforcing rod to the rock formation. An elongated bolt member is positioned in the drill hole and has a threaded end portion positioned oppositely of the reinforcing rod threaded end portion. The bolt member has an opposite end portion extending out of the entrance of the drill hole. A bearing plate is retained on the bolt member opposite end portion. A coupling having an internally threaded bore receives the threaded end portions of the reinforcing rod and the bolt member. The coupling includes a stop member that is positioned transversely in the coupling threaded bore and is operable to retain the bolt member threaded end portion spaced from the threaded end portion of the reinforcing rod in the coupling. In this manner rotation of the bolt member is transmitted through the coupling to the reinforcing rod to effect mixing and polymerization of the resin system so that the reinforcing rod is adhesively secured by the resin system to the rock formation. Upon curing of the resin system continued rotation of the bolt member shears the stop member to permit the bolt to advance through the coupling and move the bearing plate into abutting relation with the face of the rock formation. Additional rotation of the bolt member with the reinforcing rod united to the rock formation exerts a tension on the bolt member to compress the rock formation.

The resin system comprises a two component thermosetting resin composition which includes a polyester resin of the thixotropic type to permit placement in vertical holes, such as in the roof of an underground mine. The second component includes a suitable catalyst. The components are separately confined within a polyethylene cartridge. A plurality of cartridges are inserted in tandem position in the upper portion of the drill hole by the reinforcing rod.

The bolt member with the bearing plate retained thereon is inserted in the drill hole and threadedly engaged to the coupling on the reinforcing rod. The bolt member is advanced into the coupling until the threaded end portion of the bolt member contacts the stop member. The entire connected assembly is thrust upwardly into the bolt hole so that the end of the reinforcing rod fractures the resin cartridges and the resin components interact. Rotating the bolt member mixes the resin components to form a curable resin mixture. The mixture penetrates into the rock formation to adhesively unite the fissures in the rock and to unite the reinforcing rod substantially along its entire length to the rock formation. The stop member of the coupling includes a shear pin that retains the theaded end portions of the reinforcing bar and the bolt member in spaced relation to facilitate the rotation of the assembly as a unit during mixing of the resin components.

Once the resin mixture has cured to securely anchor the reinforcing rod to the rock formation rotation of the retaining member advances the bolt member in the coupling and shears the pin. Advancement of the bolt into the coupling urges the bearing plate into abutting relation with the face of the rock formation at the emergent end of th drill hole. Rotation of the bolt member with the bearing plate in abutting relation with the rock strata and the reinforcing rod bonded thereto exerts tension on the bolt member. In this manner the strata or elements of the rock formation are compressed and thus reinforced to resist the shear forces of shock waves which when propagated through the rock strata tend to separate the strata, resulting in failure of the rock formation.

Accordingly, the principle object of the present invention is to provide a method and apparatus for supporting the strata of a rock formation, such as a mine roof, by adhesively uniting the strata of the rock formation and a reinforcing rod to the rock formation and by tensioning a bolt member that is secured to the reinforcing rod anchored to the rock formation to thereby compress the rock formation.

A further object of the present invention is to provide a method and apparatus for supporting a rock formation, such as the roof of an underground mine, by a first elongated rod member that is adhesively bonded to the rock formation and connected by a coupling to a second elongated rod member so that the second elongated member is anchored to the first member and when rotated is tensioned to further support the rock formation by compressing the rock strata.

A further object of the present invention is to provide a roof control system in underground formations, such as in drilling tunnels and in mine work, that is efficiently and economically installed without the need for conventional expansion shells and reinforcing members of excessive length that are unsuitable for use in mines of low seam height.

These and other objects of the present invention will be more completely disclosed and described in the following specification, the accompanying drawings and the appended claims.

DESCRIPTION OF THE PREFERRED EMBODIMENT

Figures 5, 6, 7, 8:
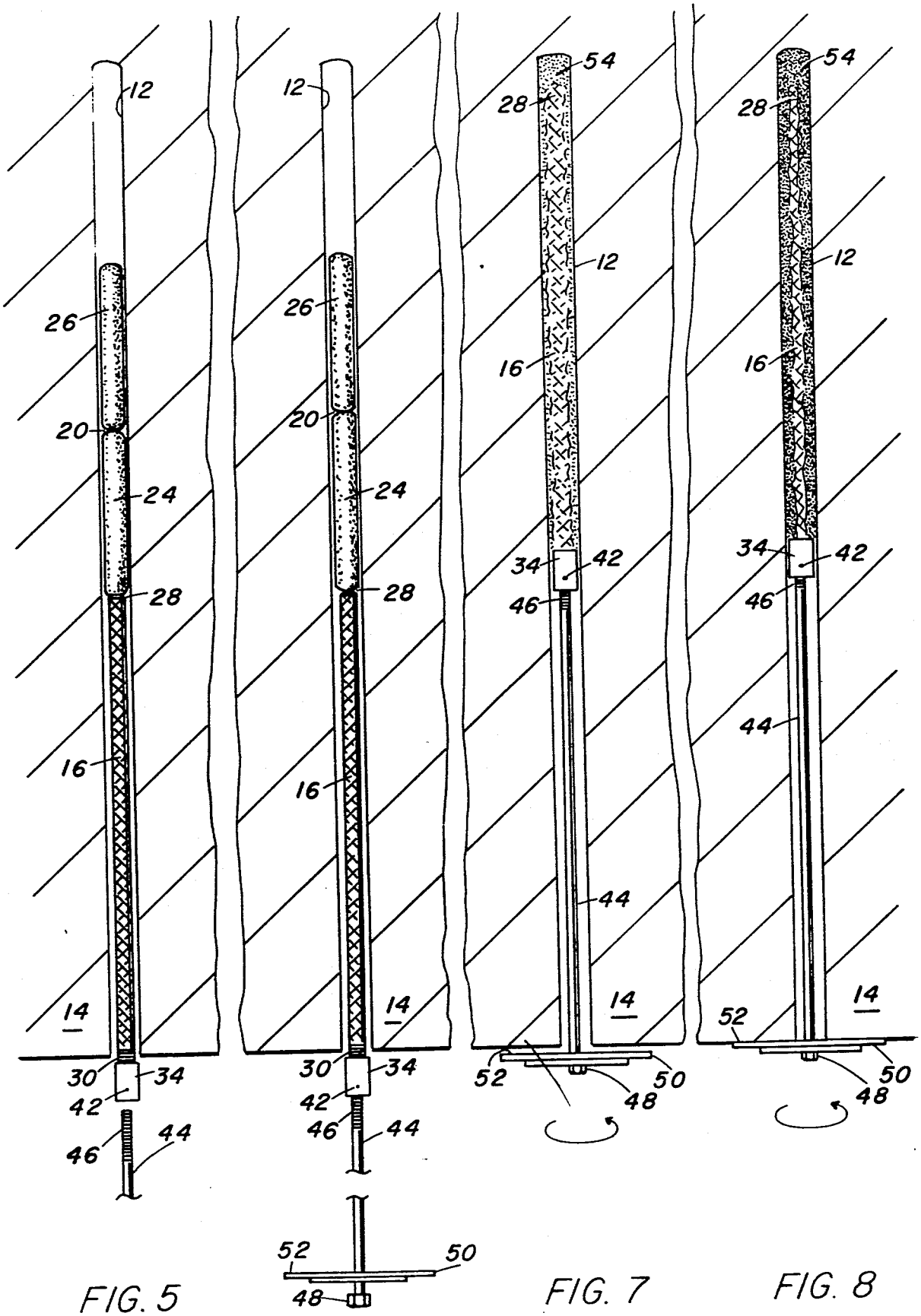
FIG. 5 is a side elevation partially in section of the first step in the method of installing the roof bolting apparatus of the present invention, illustrating the cartridges of the resin system positioned in the drill hole by the reinforcing rod with the coupling secured thereto.
FIG. 6 is a view similar to FIG. 5 illustrating the second step in the method of supporting the mine roof by advancing the reinforcing rod into the drill hole with the rod connected by the coupling to the bolt.
FIG. 7 is a view similar to FIGS. 5 and 6 illustrating the third step in supporting the mine roof of rotating the bolt to fracture the resin and mix the components of the resin to effect bonding of the reinforcing rod to the drill hole.
FIG. 8 is a view similar to FIGS. 5–7 illustrating the final step in the method for supporting the mine roof by the present invention in which the bolt is advanced through the coupling to shear the pin and urge the roof plate into contact with the mine roof and thereby apply a tension on the bolt.

Referring to the drawings and particularly to FIGS. 1–4, there is illustrated apparatus generally designated by the numeral 10 for insertion in a drill hole 12 of a rock formation 14 to support the rock formation, such as a mine roof that overlies an excavated mine shaft and the like. An elongated reinforcing rod 16 having serrations 18 on the surface thereof is positioned in the upper portion of the drill hole 12 which may be of a preselected length as determined by the load bearing properties of the roof support apparatus 10. The reinforcing rod has a diameter which is less than the diameter of the drill hole forming an annulus 20 therebetween. The annulus is filled with a resin system 22, preferably having thixotropic characteristics which will be described hereinafter in detail. The resin system 22, as illustrated in FIGS. 5 and 6, includes a plurality of cartridges 24 and 26 that are initially inserted into the drill hole 12 by pushing the cartridges into the hole with the reinforcing rod. The reinforcing rod is inserted in the drill hole 12 with the rod end portion 28 positioned in substantially abutting relation with cartridge 24 as illustrated in FIG. 5.

Figure 1:
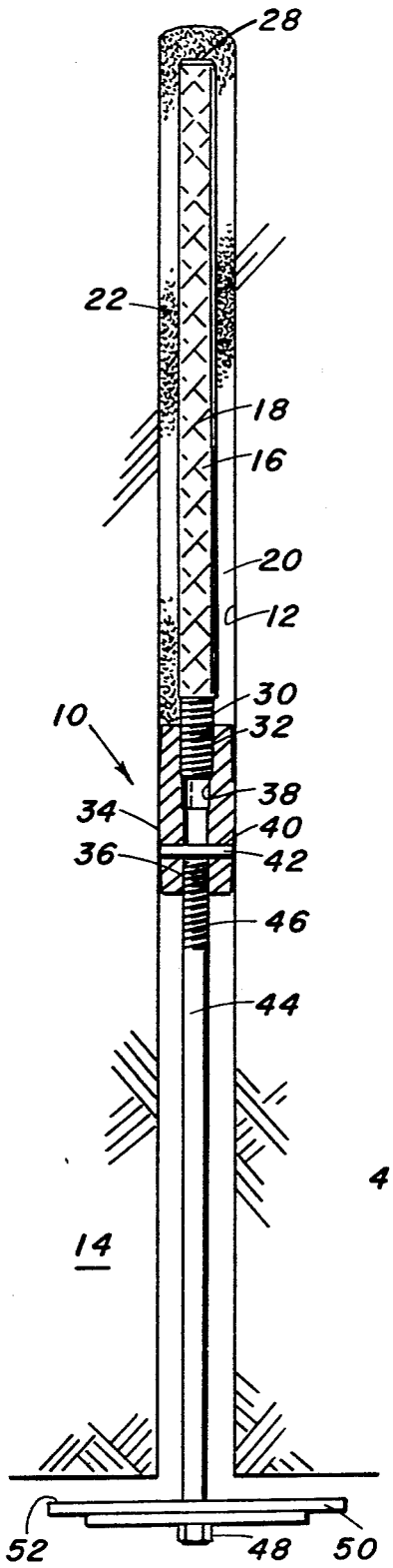
FIG. 1 is a side elevation partially in section of the roof bolting apparatus, illustrating a reinforcing rod conncted to a threaded bolt member by a coupling with the end of the threaded bolt member contacting a shear pin in the coupling and spaced from the threaded end of the reinforcing rod.
Figure 4:
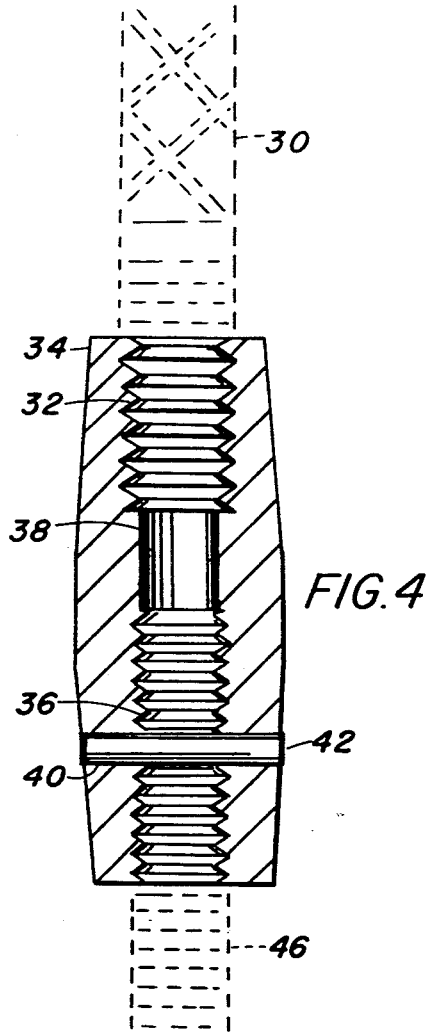
FIG. 4 is an enlarged sectional view taken along line 4—4 of FIG. 3 of the coupling, illustrating the shear pin extending transversely through the threaded bore of the coupling to initially retain the end of the bolt spaced from the end of the reinforcing rod during mixing and hardening of the resin system.
Figure 3:
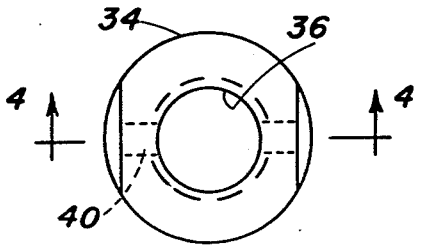
FIG. 3 is an end view of the coupling for joining together the reinforcing rod and the bolt in the drill hole.

The opposite end of reinforcing rod 16 has a threaded end portion 30 that is threadedly secured within the upper portion of a threaded bore 32 of a coupling 34. The coupling 34 has a tubular body portion with a longitudinal bore extending axially through the coupling body portion. The longitudinal bore has a lower threaded bore 36 separated from the upper threaded bore 32 by a cylindrical portion 38 positioned intermediate the coupling body portion within the longitudinal bore. A cylindrical bore 40 extends transversely through the coupling 34 and intersects the lower threaded portion 36. A stop member, such as a shear pin 42, is retained in the transverse bore 40. As illustrated in FIG. 1, the outer diameter of the coupling 34 has a diameter less than that of the drill hole 12 to permit rotation of the coupling 34 in the drill hole 12. The rod 16 also has a diameter less than that of the drill hole 12 to permit rotation therein.

Within coupling 34 the threaded bore 36 has a diameter smaller than the diameter of the threaded bore 32 and the cylindrical portion 38 between bores 36 and 32 has a diameter substantially equal to the inner diameter of the threaded bore 36. With this arrangement a shoulder is formed at the base of threaded bore 36 which serves as a stop means so that the end portion 30 of rod 16 abuts the shoulder and the rod 16 rotates with the coupling 34.

A bolt member 44, such as a conventional roof bolt, having a threaded end portion 46 is threadedly received within the threaded bore 36 of coupling 34. Initially the threaded end portion 46 is advanced into the coupling and into abutting relation with the shear pin 42 such that the shear pin retards further advancement of the bolt into the coupling 34. The bolt member 44 also has enlarged end portion 48 that serves to retain thereon a roof plate 50. The roof plate 50 has a bearing surface 52 and is arranged to engage the surface of the rock formation 14 at the emergent of the drill hole 12 and support the portion of the rock formation surrounding the emergent end of the drill hole to prevent degradation of the solid material surrounding the drill hole.

Figure 2:
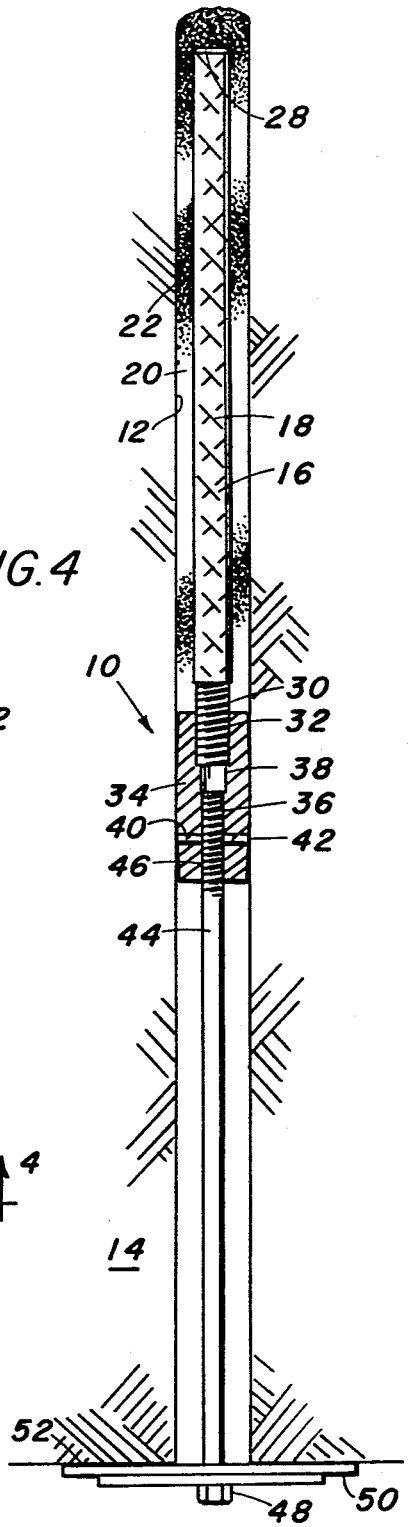
FIG. 2 is a view similar to FIG. 1, illustrating the threaded end of the bolt advanced into the coupling so that the pin is sheared and a roof plate retained on the opposite end of the bolt is urged into abutting relation with the mine roof to apply a tension on the bolt after the resin in the drill hole has cured to secure the reinforcing rod therein.

Once the resin components within the cartridges 24 and 26 are mixed by advancement of the reinforcing rod 16 in the drill hole 12 to fracture the cartridges polymerization of the resin system unites the reinforcing rod 16 with the rock formation 14 to anchor the rod thereto. Before the resin cures, the bolt 44 advances with the coupling 34 by rotation of the bolt end portion 48. Contact of the bolt end portion 46 with the pin 42, as illustrated in FIG. 1, prevents further advancement of the bolt in the coupling. However, once the resin has cured and the rod 16 is securely anchored, rotation of bolt 44 advances the bolt 44 to shear the pin 42 so that the threaded end portion 46 extends into the cylindrical portion 38 of the coupling 34 opposite the threaded end portion 30 of the reinforcing rod 16, as illustrated in FIG. 2. With the bolt 44 in this position, the roof plate 50 retained on the bolt 44 by end portion 48 is urged into contact by the bearing surface 52 with the face of the rock formation 14. With the reinforcing rod 16 anchored by resin bonding to the rock formation 14 and the roof plate 50 engaging the face of the rock formation, rotation of the bolt 44 tensions the bolt. In this manner the rock strata is not only tied together by the resin system 22 and the reinforcing rod 16 but is also compressed by the tensioned bolt 44.

The method of supporting a rock formation, such as a mine roof, by the apparatus of the present invention is illustrated in greater detail in FIGS. 5–8. Initially, as illustrated in FIG. 5, the resin cartridges 24 and 26 are inserted into the hole 12 drilled in the mine roof or rock formation 14 by the reinforcing rod 16. The cartridges are arranged in tandem relation and are pushed into the hole to substantially the end thereof. The thermosetting resin system utilized in the present invention is well known in the art of reinforcing underground formations, tunnels, excavations and faults and flaws in rock structure. Such formations are strengthened by bonding a reinforcing rod positioned in a drill hole to the rock formation. A suitable resinous composition for reinforcing underground formations is disclosed in U.S. Pat. Nos. 3,324,662 and 3,394,527 in which a thermosetting resin system includes components that are packaged in a polyethylene tube. In one compartment of the tube or cartridges 24 and 26, as illustrated in FIGS. 5 and 6, is contained a thermosetting resin which is thixotropic. The viscosity of a thixotropic resin increases as the shear rate decreases so that when the components are mixed and agitated the material has a comparatively low viscosity and when the agitation is ceased the material has a higher viscosity. This characteristic permits the resin system to remain in place temporarily during the polymerization without the problem of flowing out of the drill hole particularly when the hole is vertical. The second component packaged within cartridges 24 and 26 is a conventional peroxide type of catalyst.

With the resin system cartridges 24 and 26 inserted in the upper part of the drill hole 12, the reinforcing rod 16 having the couping 34 secured thereto is advanced upwardly into the drill hole 12 into contact with the lowermost cartridge 24. The reinforcing rod 16 is inserted as far as possible into the drill hole 12 without rupturing the cartridges and to permit connection of the bolt end portion 46 to the coupling 34. The bolt 44 with the roof plate 50 retained thereon is threadedly advanced into the coupling 34 until it contacts the shear pin 42 as illustrated in FIG. 1. Thereafter, the entire assembly of the bolt 44 and the reinforcing rod 16 connected by the coupling 34 is thrust upwardly into the drill hole 12 to facilitate rupture of the cartridges 24 and 26. Thereafter, the entire assembly is rotated in the direction indicated by the arrow in FIG. 7 by applying a torque to the bolt end portion 48.

With the bolt 44 threadedly engaged to the coupling 34 also having the rod 16 engaged thereto, rotation of the bolt 44 is transmitted to the rod 16 to effect agitation of the polyester resin and catalyst by which the components are mixed to form an essentially homogeneous curable resin mixture 54. The resin mixture by virtue of its thixotropic characteristics is retained within the drill hole 12 and polymerizes at room temperature that is at a temperature in the range between about 40°–90° F. Rotation of the rod 16 and bolt 44 for a period of time of about 20 seconds insures proper mixing of the components. The reinforcing rod 16 and the bolt 44 are held in position within the drill hole by the drilling machine until the resin has cured.

The shear pin 42 within the coupling 34 maintains the adjacent end portions of the rod 16 and the bolt 44 in spaced relation. This retains the bearing surface 52 of roof plate 50 spaced from the face of the rock formation 14. Thus, contact of the bolt 44 with the shear pin 42 to retain the roof plate 50 spaced from the rock formation permits the entire roof support assembly to rotate as a single unit during the mixing of the resin components. The assembly is retained in this position for a period of time of about 2 minutes to allow the resin system to set and permit the resin to flow into fissures and faults of the rock structure. In this manner the rock strata and rock elements are adhesively united to further strengthen the rock formation.

After the resin system has cured to sufficiently adhere the rock strata to each other and to bond the reinforcing rod 16 to the rock formation, the bolt end portion 48 is rotated to shear the pin 42 and advance the bolt threaded end portion 46 through the coupling threaded bore 36 with the end portion of the bolt 44 projecting into the cylindrical portion 38 of coupling 34, as illustrated in FIG. 2. Shearing of the pin 42 moves the roof plate 50 into contact with the face of the rock formation so that the bearing surface 52 abuts the rock formation surrounding the entrance into the drill hole 12.

The annulus surrounding the reinforcing rod 16 between the coupling 34 and the end of the hole 12 is completely occupied by the resin so as to rigidly bond or anchor the rod 16 to the rock formation 14. Thus, with the rod 16 fixed within the drill hole 12 further rotation of the anchor bolt 44 having the bearing surface 52 in contact with the face of the rock formation applies a tension on the bolt 44. Drawing the bolt 44 up under tension in this manner serves to compress the layers of the rock strata and thereby reinforce the strata to resist the vibrations and shock waves that tend to shear apart the overlying layers of the rock strata, resulting in ultimate failure of the formation. Mechanically interlocking the rock strata by penetration of the resin into the rock fissures and tensioning the bolt 44 by securing it to the anchored reinforcing rod 16 provides substantially improved resistance to tension and shear failures of the rock formation in comparison with a reinforcing rod bonded to the rock strata by resin alone or by a conventional roof bolt drawn under tension and secured to the rock formation by an expansion shell.

It will be apparent that the method and apparatus of the present invention provides a roof support system that is efficiently and economically assembled to reinforce an underground formation. An effective roof support system is provided by the present invention without the need for expensive components such as expansion shells. Further by connecting the reinforcing rod 16 to the bolt 44 by the coupling 34 the problem of inserting a single bolt of substantial length is avoided. The present invention permits the installation of a roof support system by components to overcome the problem of inserting roof bolts of substantial length in mine seams of low height. Not only does the roof support apparatus 10 provide for interlocking the rock strata by the injection of a thermosetting resin but also places the rock strata under compression so that the strata may resist shear forces that cause failure of a mine roof that occur primarily due to vibrations from rotating machinery, such as mine roof drills which propagate shock waves through the rock strata.

It should be understood, although the preferred method of securing the rod 16 to the bore hole 12 is a resin system 22, other methods and apparatus, such as expansion shells or the like, may be employed to secure the rod 16 to the bore hole 12 while retaining the advantageous features of eliminating a single bolt of substantial length in a low height mine and maintaining the desired bolt tension.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for insertion in a drill hole of a rock formation to support the rock formation comprising, an elongated reinforcing rod positioned in the drill hole, said reinforcing rod having one end portion positioned adjacent the end of the drill hole and an opposite threaded end portion, a resin system mixed and cured in the drill hole and filling the annulus between the rock formation and said reinforcing rod to anchor said reinforcing rod to said rock formation, an elongated bolt member positioned in the drill hole, said bolt member having a threaded end portion positioned oppositely of said reinforcing rod threaded end portion and an opposite end portion extending out of the entrance to the drill hole, a bearing plate retained on said bolt member opposite end portion, a coupling having an internally threaded bore for receiving said reinforcing rod threaded end portion and said bolt member threaded end portion, stop means positioned in said coupling for maintaining said bolt member threaded end portion in a first position within said coupling spaced from said reinforcing rod threaded end portion to permit rotation of said bolt member and said reinforcing rod, and said bolt member operable upon rotation to shear said stop means and advance in said coupling to urge said bearing plate into engagement with the rock formation and apply tension on said bolt member with said reinforcing rod anchored within said drill hole.

2. Apparatus for insertion in a drill hole of a rock formation to support the rock formation as set forth in claim 1 which includes, said bolt member threaded end portion arranged in said first position within said coupling in abutting relation with said stop means to maintain said threaded end portions of said bolt member and said reinforcing rod in spaced relation, and said bearing plate being spaced from the rock formation with said bolt member threaded end portion in said first position so that upon rotation of said bolt member said bolt member and said reinforcing rod are free to rotate as a single unit.

3. Apparatus for insertion in a drill hole of a rock formation to support the rock formation as set forth in claim 1 in which said resin system includes, a thixotropic polyester resin composition consisting essentially of a mixable and curable thermosetting resin and a catalyst, a cartridge for separately storing said thermosetting resin and said catalyst prior to mixing, and a plurality of said cartridges being positioned in tandem relation in the drill hole between the end thereof and the end of said reinforcing rod.

4. Apparatus for insertion in a drill hole of a rock formation to support the rock formation as set forth in claim 3 which includes, said reinforcing rod being operable to advance within said drill hole to fracture said cartridges such that said thermosetting resin and said catalyst from a curable resin mixture, and said resin mixture when cured being operable to adhesively bond said reinforcing rod within the drill hole to the rock formation to anchor said reinforcing rod thereto.

5. Apparatus for insertion in a drill hole of a rock formation to support the rock formation as set forth in claim 1 which includes, said stop means being positioned transversely to said threaded bore to maintain said bolt member threaded end portion in said first position so that said bearing plate is spaced from the rock formation as said resin system cures, and said bolt member threaded end portion being operable upon rotation relative to said coupling to shear said stop means and advance in said coupling toward said reinforcing rod threaded end portion so that upon rotation of said bolt member said bearing plate moves into abutting relation with the rock formation to apply a tension on said bolt member.

6. Apparatus for insertion in a drill hole of a rock formation to support the rock formation as set forth in claim 1 in which said coupling includes, a cylindrical bore intersecting with and positioned transversely to said threaded bore, and said stop means including a shear pin positioned in said coupling cylindrical bore.

7. Method for supporting a rock formation comprising, advancing an elongated reinforcing rod in a hole drilled in the rock formation, connecting said reinforcing rod to an elongated bolt membe with the end portion of said bolt member in spaced relation to the adjacent end of said reinforcing rod, said bolt member having a bearing plate secured thereto and positioned adjacent the rock formation externally of the drill hole, maintaining said bearing plate in spaced relation to the rock formation to permit rotation of said reinforcing rod and said bolt member as a unit, adhesively bonding said reinforcing rod in the drill hole to the rock formation, and thereafter rotating said bolt member relative to said reinforcing rod after said reinforcing rod is bonded to the rock formation to move said bolt member end portion toward said adjacent end of said reinforcing rod and said bolt member bearing plate into abutting relation with the rock formation to tension said bolt member.

8. Method for supporting a rock formation as set forth in claim 7 which includes, inserting a packaged resin system in the drill hole, advancing said reinforcing rod in the drill hole to fracture said packaged resin system to effect mixing of the resin components, maintaining said bolt member spaced from said reinforcing rod to permit rotation of said bolt member, rotating said bolt member to rotate said reinforcing rod and mix said resin components, and maintaining said bolt member in the drill hole with said bearing plate spaced from the rock formation for a preselected period of time to allow said mixed resin components to cure and bond said reinforcing rod to the rock formation.

9. Method for supporting a rock formation as set forth in claim 7, connecting the opposite end portions of said reinforcing bar and said bolt member in the drill hole by a coupling member, maintaining said opposite end portions in spaced relation within said coupling by a shear pin within said coupling so that said bearing plate is spaced from the rock formation, and rotating said bolt member to transmit rotation through said coupling to said reinforcing rod and effect mixing of said resin components.

10. Method for supporting a rock formation as set forth in claim 9 which includes, anchoring said reinforcing rod to the rock formation by curing of said resin components, rotating said bolt member to break said shear pin so that said bolt member advances in said coupling to urge said bearing plae into abutting relation with the rock formation and apply a tension on said bolt member with said reinforcing rod anchored to the rock formation so that the rock formation is compressed.

11. A coupling for joining together the threaded end portion of a pair of cylindrical members comprising, an elongated tubular body portion, a longitudinal bore extending axially through said body portion, said bore having a first threaded portion operable to threadedly receive one of the cylindrical members, said bore having a second threaded portion spaced from said first threaded portion for threadedly receiving the other of the cylindrical members, a first stop means to permit rotation of said other cylindrical member with said coupling, second stop means extending transversely from said body portion and intersecting said first threaded portion for retaining the end of said one cylindrical member in spaced relation from the end of said other cylindrical member within said body portion and permit rotation of said one cylindrical member.

12. The coupling for joining together the threaded end portions of a pair of cylindrical members as set forth in claim 11 which includes, a cylindrical portion within said bore positioned between said first and second threaded portions, said cylindrical portion having a diameter less than the diameter of said second threaded portion and forming said first stop means.

13. The coupling for joining together the threaded end portions of a pair of cylindrical members as set forth in claim 12 in which said cylindrical portion includes, a diameter equal to the inner threaded diameter of said first threaded portion.

14. The coupling for joining together the threaded end portions of a pair of cylindrical members as set forth in claim 11 which includes, said first threaded portion extending from one end of said body portion to adjacent the intermediate portion thereof, said second threaded portion extending from the other end of said body portion to adjacent the intermediate portion thereof, and a cylindrical portion extending between the spaced adjacent end portions of said first and second threaded portions intermediate said body portion.

15. The coupling for joining together the threaded end portions of a pair of cylindrical members as set forth in claim 11 which includes, a bore extending transversely through said body portion adjacent one end portion thereof, said transverse bore intersecting and extending transversely through said first threaded portion substantially intermediate said first threaded portion, and said second stop means being positioned within said transverse bore such that in said first position the end of said one cylindrical member abuts said second stop means to initially prevent advancement of said one cylindrical member through said first threaded portion.

16. The coupling for joining together the threaded end portions of a pair of cylindrical members as set forth in claim 11 which includes, said second stop means including a shear pin.

17. The coupling for joining together the threaded end portions of a pair of cylindrical members as set forth in claim 11 which includes, said second stop means including a shear pin being operable to shear upon advancement of said one cylindrical member to permit advancement thereof through said first threaded portion to a position within said first threaded portion adjacent the end of said other cylindrical member.

18. Apparatus for insertion in a drill hole of a rock formation to support the rock formation comprising, an elongated reinforcing rod positioned in the drill hole, said reinforcing rod having one end portion positioned adjacent the end of the drill hole and an opposite threaded end portion, means securing said reinforcing rod to said rock formation, an elongated bolt member positioned in the drill hole, said bolt member having a threaded end portion positioned oppositely of said reinforcing rod threaded end portion and an opposite end portion extending out of the entrance to the drill hole, a bearing plate retained on said bolt member opposite end portion, a coupling having an internally threaded bore for receiving said reinforcing rod threaded end portion and said bolt member threaded end portion, stop means positioned in said coupling for maintaining said bolt member threaded end portion in a first position within said coupling spaced from said reinforcing rod threaded end portion to permit rotation of said bolt member and said reinforcing rod, and said bolt member operable upon rotation to shear said stop means and advance in said coupling to urge said bearing plate into engagement with the rock formation and apply tension on said bolt member with said reinforcing rod secured within said drill hole.

19. Method for supporting a rock formation comprising, advancing an elongated reinforcing rod in a hole drilled in the rock formation, connecting said reinforcing rod to an elongated bolt member with the end portion of said bolt member in spaced relation to the adjacent end of said reinforcing rod, said bolt member having a bearing plate secured thereto and positioned adjacent the rock formation externally of the drill hole, maintaining said bearing plate in spaced relation to the rock formatin to permit rotation of said reinforcing rod and said bolt member as a unit, securing said reinforcing rod in the drill hole to the rock formation, and thereafter rotating said bolt member relative to said reinforcing rod after said reinforcing rod is secured to the rock formation to move said bolt member end portion toward said adjacent end of said reinforcing rod and said bolt member bearing plate into abutting relation with the rock formation to tension said bolt member.

* * * * *